United States Patent [19]

Morrow

[11] 4,261,541

[45] Apr. 14, 1981

[54] MANHOLE SEWER PIPE OPENING BLOCKOUT MEMBER

[76] Inventor: Otis L. Morrow, 723 Eastlake, Houston, Tex. 77034

[21] Appl. No.: 126,974

[22] Filed: Mar. 3, 1980

[51] Int. Cl.[3] ..... B28B 7/16; B29C 1/14

[52] U.S. Cl. ..... 249/10; 249/163; 249/169; 249/177; 264/32; 403/294; 405/153; 425/59

[58] Field of Search ..... 52/19–21, 52/578, 579, 582, 584, 726; 249/1, 10, 163, 184, 188, 142, 144, 168, 160, 165, 169, 175, 45, 47, 145, 176, 177; 425/59; 405/133, 150, 153; 403/294, 344, 292, 293; 264/32–35

[56] References Cited

U.S. PATENT DOCUMENTS

| | | | |
|---|---|---|---|
| 1,188,485 | 6/1916 | Prijyn | 52/726 |
| 1,202,134 | 10/1916 | White et al. | 249/1 |
| 1,594,505 | 8/1926 | Frye | 52/721 |
| 1,793,525 | 2/1931 | Stafford | 52/721 |
| 2,308,806 | 1/1943 | Davis | 249/184 |
| 2,373,808 | 4/1945 | Brown | 52/584 |
| 2,623,259 | 12/1952 | Schuh | 249/145 |
| 3,363,876 | 1/1968 | Moore | 249/145 |
| 3,601,995 | 8/1971 | Seiz | 405/153 |
| 3,729,165 | 4/1973 | Trimble | 249/1 |
| 4,127,990 | 12/1978 | Morrow | 264/32 |

FOREIGN PATENT DOCUMENTS

| | | | |
|---|---|---|---|
| 1198999 | 12/1959 | France | 405/153 |
| 92200 | 10/1968 | France | 405/150 |
| 423919 | 5/1967 | Switzerland | 52/21 |

*Primary Examiner*—W. E. Hoag

*Attorney, Agent, or Firm*—Pravel, Gambrell, Hewitt, Kirk, Kimball & Dodge

[57] ABSTRACT

An improved manhole concrete blockout for forming sewer pipe openings in the cast-concrete wall of a manhole where a hole is dug in the ground and at least one vertical hollow form is positioned within the hole and spaced apart from the surface which defines the hole and concrete is poured between the surface defining the hole and the form for forming a manhole wall. A plurality of form sections are connected together so that their outer surfaces can be positioned to become a longitudinal extension of the outer surface of the form. A blockout member is connected to the outer surface of at least one of the sections for forming an opening in the manhole wall, the end adjacent to the section being shaped to engage and conform to the outer surface of the section and the other end being shaped to conform to and engage the corresponding portion of the surface defining the hole so that an opening in the shape of the blockout member will extend through the wall when it is formed. The outer surface of the blockout member gradually decreases in cross-section away from the section, and the sections are disconnectable so that when the wall is formed the sections can be removed individually inwardly so that the blockout member can be withdrawn from the opening formed in the wall.

9 Claims, 8 Drawing Figures

Fig. 1
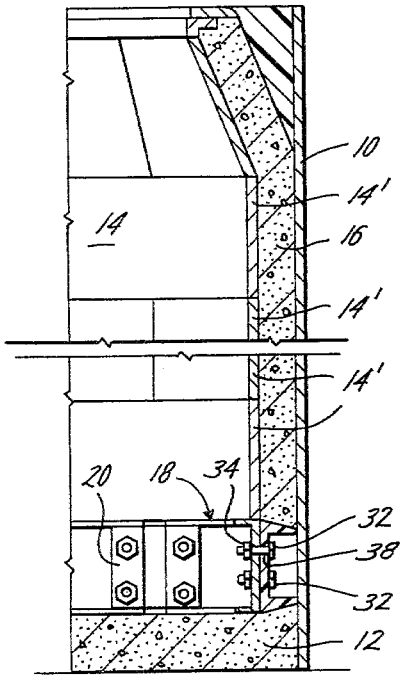
Fig. 2
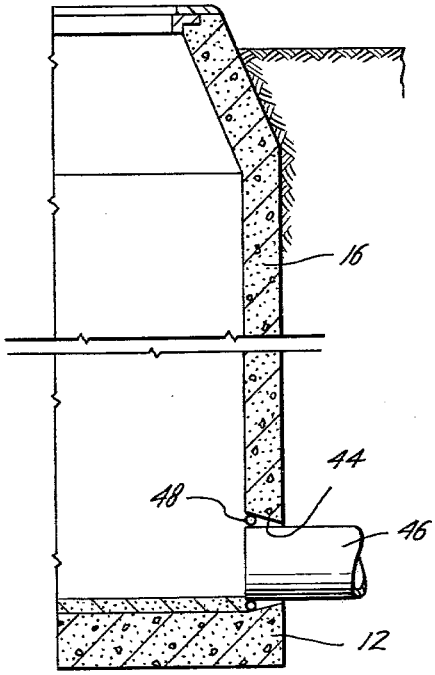
Fig. 3
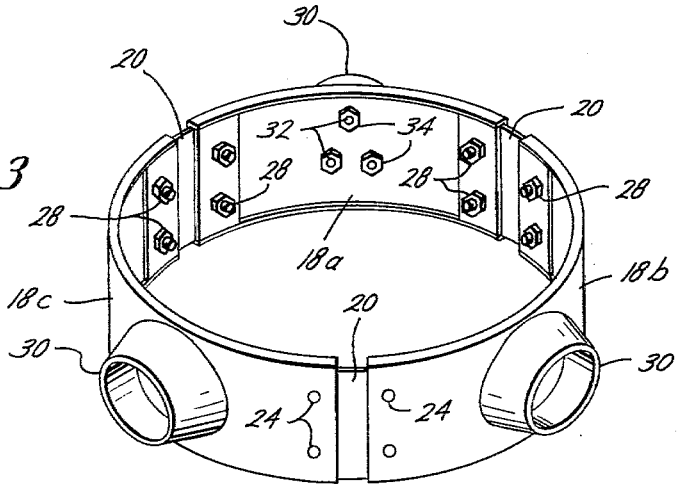
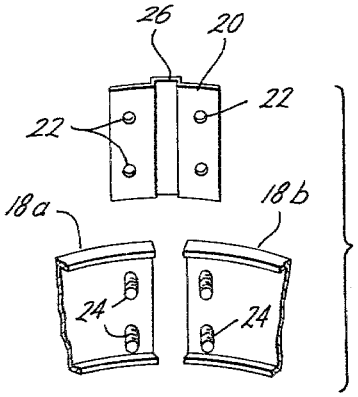
Fig. 4

Fig. 5
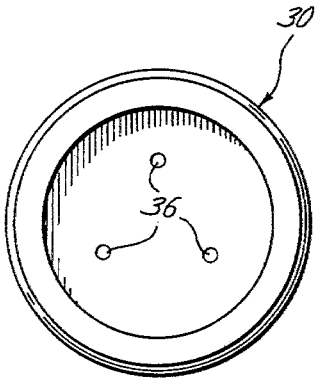
Fig. 7
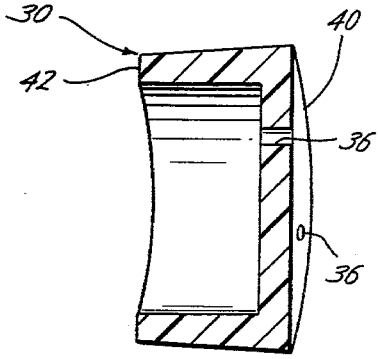
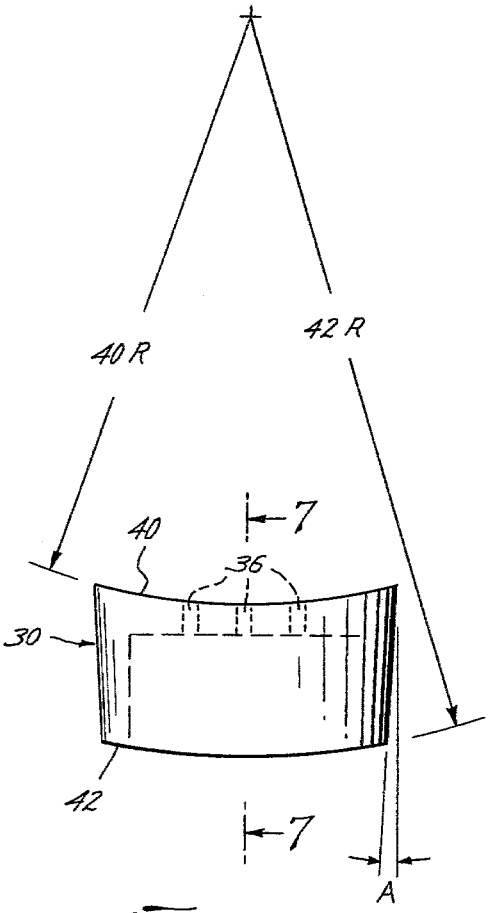
Fig. 6
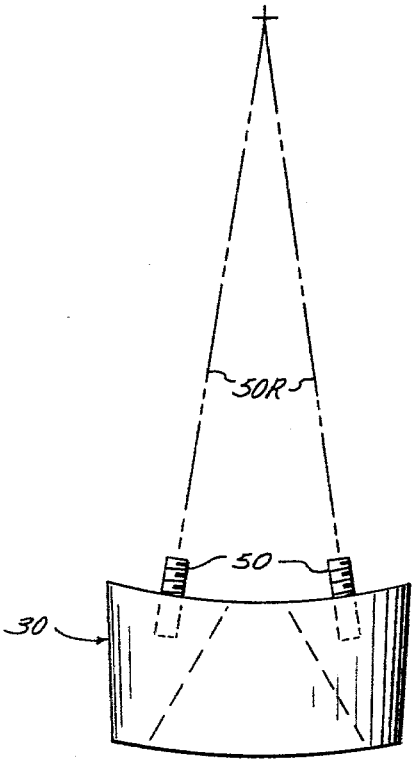
Fig. 8

MANHOLE SEWER PIPE OPENING BLOCKOUT MEMBER

BACKGROUND OF THE INVENTION

This invention relates to manholes formed of cast-concrete walls and, more particularly, to an apparatus which can be used to form holes to accommodate sewer pipe in the wall of such a manhole.

It has been found that manholes can most expeditiously be formed by drilling a hole in the ground, placing at least one cylindrical form within the hole and pouring concrete between the form and the wall of the hole. A manhole formed in such a manner is described in U.S. Pat. No. 4,127,990, the subject matter of which was invented by the same individual who is the inventor of the present invention. The subject matter of that patent is incorporated herein as though fully set forth.

In the embodiment of the invention which is the subject of that patent shown in FIGS. 5 and 6 and discussed in col. 4, lns. 54–69 and col. 5, lns. 1–47, a manhole is formed prior to the laying of sewer pipe by excavating a hole and positioning an outer form in the hole. An inner form is positioned concentric with the outer form with its lower end higher than the lower end of the outer form and concrete is poured to form a base between the ends of the forms. Alternatively, the base can be formed before the inner form is moved into place.

When the two forms are appropriately positioned after the base is poured, small quantities of sand are placed above the base and between the two forms generally in locations where sewer pipes will be connected to the manhole. Concrete is then poured between the forms. After the concrete cures and the forms are removed as described in the patent the sand either falls away or can easily be removed and small openings in the wall where the sand was positioned during the pouring of the concrete are then manually enlarged with a chisel or the like for providing holes through which sewer pipe can communicate with the inner cavity of the manhole.

This method of forming sewer pipe holes is time consuming and expensive. Although other types of non-reusable concrete blockouts have been used, no suitable apparatus is known which can effectively be used as part of the form which has the capability of being reused.

SUMMARY OF THE INVENTION

In accordance with the present invention, a re-usable concrete blockout assembly is provided which is part of the wall form and operates to provide holes in a cast-concrete manhole wall in their final form for eliminating the need for any additional removal of concrete before the sewer pipe is connected to the manhole.

The invention can be used when only an inner form is provided and concrete is poured between it and the earthen walls of the hole or, as taught in U.S. Pat. No. 4,127,990, where the hole is lined with an outer form and concrete is poured between the two forms. In either case, an extension of the inner form is provided which is made up of a plurality of form sections which are connected together so that their outer surfaces become a longitudinal extension of the inner form. For each sewer pipe opening which must be provided in the wall of the manhole, a blockout member is connected to the outer surface of one of the sections.

The blockout member has an outer peripheral surface which is in the shape of a conical frustum, the end adjacent to the section to which it is connected is shaped to engage and conform to the outer surface of that section and the outer end is shaped to conform and engage the hole or form surface which defines the outer wall of the manhole.

With the conical shape, the outer peripheral surface of the blockout member gradually decreases in diameter away from the inner form. This shape along with the fact that the sections are disconnectable and can be individually removed inwardly into the manhole enables the blockout members to be withdrawn from their respective openings after the manhole wall is formed. The blockout members can be disconnected from the sections so that they can be removed separately or they can be removed along with the section.

In this way, precisely located and shaped openings can be formed in the wall of the manhole for accommodating sewer pipe which is to be laid after the manhole is formed. An additional advantage of the blockout members is that when a plurality of them are spaced around the outer surface of the inner form, proper spacing of the inner form relative to the outer one is provided so that the manhole wall has a uniform thickness throughout. Removal of the blockout members is a simple operation and the holes for accommodating the sewer pipe are formed in their final shape so that no additional work is necessary. The conical shape of the outer surface of each blockout member provides a hole where an end of the length of sewer pipe can be inserted and an appropriate sealing member or ring easily fitted between the pipe and the surface of the hole for providing a fluid-tight seal.

BRIEF DESCRIPTION OF THE DRAWINGS

A better understanding of the invention can be obtained when the detailed description of the preferred embodiments set forth below is considered in conjunction with the accompanying drawings, in which:

FIG. 1 is a partial front sectional view of a manhole in which appropriate forms are used for the walls, including a blockout member connected to an extension of the form for providing a sewer pipe opening in the wall;

FIG. 2 is a side sectional view of the manhole of FIG. 1 after the forms have been removed and the sewer pipe is in place;

FIG. 3 is a perspective view of a form extension on which a plurality of concrete blockout members are mounted;

FIG. 4 is an exploded perspective view of the longitudinal extension of FIG. 1 showing, in particular, the connector for the sections wich make up the extension;

FIG. 5 is a front plan view of one embodiment of a blockout member;

FIG. 6 is a top plan view of the blockout member of FIG. 5;

FIG. 7 is a side sectional view of the blockout member of FIGS. 5 and 6 looking along a section line shown in FIG. 5 in the direction of arrows 7–7; and FIG. 8 is a top plan view of a second embodiment of a blockout member.

DETAILED DESCRIPTION OF A PREFERRED EMBODIMENT

FIG. 1 shows how appropriate forms can be positioned for fabricating a cast-concrete manhole. A method for fabricating such a manhole is set forth in U.S. Pat. No. 4,127,990, the subject matter of which, as mentioned above, is totally incorporated herein. A vertical hole is excavated by an auger or the like (not shown). An outer form 10 can be inserted in the hole as shown in FIG. 1, but the subject invention can also be used where the surrounding earthen walls define the holes. A base portion 12 for the manhole is first formed either by pouring concrete in the hole or by positioning an inner form 14 above the bottom of the hole and pouring concrete up to the lower end of the form 14.

The inner form 14 is made up of a plurality of form sections 14' which are stacked on top of each other and which can be individually removed. Concrete is poured between the form 14 and either the form 10 or the earthen wall in order to fabricate the wall 16 of the manhole. Although the manhole shown in FIG. 1 has a bell shaped upper end, manholes of other configurations can be used in conjunction with the invention.

As shown in FIG. 1, the form 14 includes a lower extension portion 18 which, as shown best in FIG. 3, is formed of three separate sections 18*a*, 18*b* and 18*c* so that the extension 18 can be disassembled and individual sections pulled inwardly and removed as discussed in detail below. The sections are connected to each other through overlapping connector sections 20 which have a plurality of holes 22 through which bolts 24 project which are connected to the sections which make up the extension 18. As shown best in FIG. 4, the connector section 20 includes an indented or projecting portion 26 which fits between the spaced apart adjacent sections of the extension 18 and fills the gap between them so that a smooth outer surface is formed which conforms with the outer surface of the remainder of the liner 14. Suitable nuts 28 are threaded onto the bolts 24 for holding the connector sections 20 in place when the extension 18 is in the position shown in FIG. 1.

In the embodiment shown in FIGS. 1 and 2, a blockout member 30 is connected to the outer surface of each of the sections which make up the extension 18 by means of a plurality of bolts 32 and nuts 34, the bolts 32 projecting through corresponding openings 36 located in the rear wall of the blockout member 30 and openings 38 formed in each of the sections which make up the extension 18. As shown best in FIGS. 5, 6 and 7 the blockout members 30 have the shape of a conical frustum with their inner ends 40 adapted to conform to and engage the outer surface of the extension 18 around the entire periphery of the end 40 which is illustrated by the curved profile of the end 40 in the top view shown in FIG. 6 and the flat profile of the side section view shown in FIG. 7. Each blockout member 30 also includes an outer end 42 which conforms to and engages around its entire periphery the inner surface of the form 10 or, if no such form is used, the earthen surface which defines the hole. This is likewise shown by the curved top profile shown in FIG. 6 and the flat side profile of FIG. 7.

When the inner and outer surfaces 40 and 42 of the blockout members are formed to engage the surfaces which define the wall 16, they can have the same length, looking in the direction shown in FIG. 6, and provide a conical frustum shape on their sides. As shown by the radius lines 40R and 42R, the surfaces 40 and 42 have different radii so that when their respective arc segments are the same length the different curvatures will cause the sides to be tapered. The sides of the blockout members are preferably tapered at an angle of about three degrees as indicated by arrows A—A in FIG. 6.

The interior of the blockout member 30 can be hollowed out as shown in FIGS. 6 and 7. A material found to be suitable for these blockout members is urethane plastic with a hardness of about 60 on the Shore durometer scale. Alternatively, other blockout member shapes can be used, depending on the shape of the sewer pipe, as long as the cross-section of the blockout member diminishes in size away from the form 14 and the inner and outer side ends are shaped as described above to conform to and engage their respective adjacent surfaces which form the wall 16.

In addition to forming appropriate holes in the manhole wall 16, the blockout members 30 operate as spacers for maintaining the inner form 14 equidistant from the outer form around its entire periphery so that the wall 16 has a uniform thickness. After the concrete is poured and the wall is formed such as, for example, in accordance with the method described in U.S. Pat. No. 4,127,990, the inner form sections 14' are individually removed leaving the extension 18. The extension sections are disconnected from each other by removing the connector sections 20 as described above, so that the extension sections can then be pulled inwardly one-by-one. The blockout members 30 are removed from the holes which they formed in the wall 16 along with their respective extension sections or, alternatively, the nuts 34 can be removed frm the bolts 32 so that the extension sections 18 are first pulled inwardly and then the individual blockout members removed from their respective holes. The tapered sides of the blockout members 30, in addition to allowing for easy removal of the members from their respective holes 44 and operating as a spacer for the form 18, also operate to provide a recess between the end of a sewer pipe 46 and the surface defining the openings 44 so that an O-ring 48 or other appropriate seal can fit between the outer surface of the pipe 46 and the surface which defines the opening 44, as shown best in FIG. 2. After a sewer pipe 46 is inserted in each of the holes 44, the base 12 can be coated with a cement mortar surface to bring the base up to the level of the sewer pipe so that stagnant water will not collect in the manhole.

As shown in FIG. 8, the blockout member 30 can be formed in other types of configurations, maintaining the same conical frustum shape of its outer surfaces and having ends shaped as described above. The blockout member 30 shown in FIG. 8, instead of having bolt holes includes at least a pair of bolts 50 which are molded into the material of the member and oriented toward the center of the manhole as shown by the radius lines 50R. This shape can be used where larger openings are to be formed in the manhole wall and the interior is hollowed out in a V-shape to save material and lighten the member. The members, however, can also be formed solid with bolt openings extending throughout or have bolts molded as shown in FIG. 8.

As is apparent from the foregoing detailed description, one or more blockout members 30 can be connected to the extension 18 and the extension 18 can be formed of any suitable number of extension sections. The extension sections enable the extension 18 to be dismantled and pulled inwardly into the manhole opening so that the blockout members can be removed from their respective openings. The blockout members of the configuration described above, operate to form finished holes for sewer pipe in the manhole wall, space the inner form from the outer surface of the hole, and provide a recess for a sealing ring between the sewer pipe and opening.

The foregoing disclosure and description of the invention are illustrative and explanatory thereof, and various changes in the size, shape and materials as well as in the details of the illustrated construction may be made without departing from the spirit of the invention and all such changes are contemplated as falling within the scope of the appended claims.

I claim:

1. Improved manhole concrete blockout for forming sewer pipe openings in the cast-concrete wall of a manhole where a hole is dug in the ground and at least one vertical hollow form is positioned within the hole and spaced apart from the surface which defines the hole and concrete is poured between the surface which defines the hole and concrete is poured between the surface defining the hole and the form for forming a manhole wall, the improvement comprising a plurality of form sections, means for connecting the sections together so that their outer surfaces can be positioned to become a longitudinal extension of the outer surface of the form, at least one block out member, in the form of a sleeve connected to the outer surface of at least one of the sections and having a connection only to the extension for forming an opening in the manhole structure wall, the end adjacent to the section being shaped to engage and conform to the outer surface of the section and the other end being shaped to conform to and engage the corresponding portion of the surface defining the hole so that an opening in the shape of the blockout member will extend through the wall when it is formed, the outer surface of the blockout member gradually decreasing in cross-section away from the section, and the sections being disconnectable so that when the wall is formed the sections can be removed individually inwardly so that the blockout member can be withdrawn from the opening formed in the wall.

2. The improvement of claim 1, wherein the outer surface of the form has a cylindrical shape and the outer surface of the blockout member has a conical frustum shape.

3. The improvement of claim 1, wherein a blockout member is connected to each section.

4. The improvement of claim 1, wherein the means for connecting the sections together includes a connecting member adapted to overlap the adjacent ends of the sections, said adjacent ends being spaced apart when they are connected together, corresponding bolt holes in the connecting member and each of said adjacent ends, and the connecting member including a projecting portion for forming an extension of the outer surfaces of the sections and filling the gap between the adjacent ends.

5. The improvement of claim 1, wherein the blockout member and its respective section include corresponding bolt holes for removably connecting the member to the section.

6. The improvement of claim 1, wherein the blockout member includes a plurality of bolts molded therein and positioned to project through corresponding openings in its respective form section.

7. The improvement of claim 1, wherein the blockout member has a hollowed-out interior.

8. The improvement of claim 1, wherein the blockout member is solid.

9. The improvement of claim 2, wherein the profiles of the inner and outer ends of the blockout member as they extend around their adjacent surfaces are arc segments having the same length, and the side surfaces of the blockout member are tapered at an angle of about 3°.

* * * * *

UNITED STATES PATENT AND TRADEMARK OFFICE

CERTIFICATE OF CORRECTION

PATENT NO. : 4,261,541

DATED : April 14, 1981

INVENTOR(S) : Otis L. Morrow

It is certified that error appears in the above-identified patent and that said Letters Patent are hereby corrected as shown below:

Column 4, line 16, delete "side".

Column 4, line 34, delete "frm" and insert --from--.

Signed and Sealed this

*Fourteenth* Day of *July 1981*

[SEAL]

*Attest:*

GERALD J. MOSSINGHOFF

*Attesting Officer*

*Commissioner of Patents and Trademarks*